US011208249B2

(12) United States Patent
Ellis et al.

(10) Patent No.: US 11,208,249 B2
(45) Date of Patent: Dec. 28, 2021

(54) POUCH WITH INTEGRATED SPOUT AND RECLOSABLE FEATURE FOR DISPENSING AND ASSOCIATED METHODS

(71) Applicant: Cryovac, LLC, Charlotte, NC (US)

(72) Inventors: Matthew Ellis, Greer, SC (US); Dwight Smith, Simpsonville, SC (US); Daniel McKamy, Simpsonville, SC (US); Joseph Ramirez, Greenville, SC (US)

(73) Assignee: Cryovac, LLC, Charlotte, NC (US)

( * ) Notice: Subject to any disclaimer, the term of this patent is extended or adjusted under 35 U.S.C. 154(b) by 0 days.

(21) Appl. No.: 16/638,494

(22) PCT Filed: Aug. 13, 2018

(86) PCT No.: PCT/US2018/046415

§ 371 (c)(1),
(2) Date: Feb. 12, 2020

(87) PCT Pub. No.: WO2019/036315

PCT Pub. Date: Feb. 21, 2019

(65) Prior Publication Data

US 2020/0262632 A1 Aug. 20, 2020

Related U.S. Application Data

(60) Provisional application No. 62/555,709, filed on Sep. 8, 2017, provisional application No. 62/545,100, filed on Aug. 14, 2017.

(51) Int. Cl.
*B65D 75/58* (2006.01)
*B65B 9/20* (2012.01)
(Continued)

(52) U.S. Cl.
CPC ..... *B65D 75/5866* (2013.01); *B65B 9/2056* (2013.01); *B65B 61/18* (2013.01); *B65B 61/202* (2013.01); *B65D 2575/586* (2013.01)

(58) Field of Classification Search
CPC ..... B65D 75/5866; B65D 2575/586
(Continued)

(56) References Cited

U.S. PATENT DOCUMENTS 2,394,335 A * 2/1946 Shapiro ..... B65D 33/20 383/9
4,124,049 A * 11/1978 Yamaguchi ..... B65D 88/1656 220/216
(Continued)

FOREIGN PATENT DOCUMENTS

DE 2624680 A1 * 12/1976 ..... B65D 75/54
EP 2612825 A1 * 7/2013
(Continued)

OTHER PUBLICATIONS

Machine translation of FR-2934576-A1.*
(Continued)

*Primary Examiner* — Jes F Pascua
(74) *Attorney, Agent, or Firm* — Jon M. Isaacson

(57) ABSTRACT

A package and method of creating a package for dispensing a product are disclosed. The package comprises a flexible pouch comprising an elongated spout and a flowable product disposed within the pouch. A spout retainer is disposed on an exterior surface of the pouch adjacent to the spout, with opposite ends of the spout retainer attached to the exterior surface of the pouch to form two bridges, each of the bridges having a bridge width that is wider than a spout width to allow the spout to pass underneath each of the two bridges. The package may be manufactured on a vertical form-fill-
(Continued)

seal machine where the pouch and spout retainer are formed from different supplies of film material.

6 Claims, 9 Drawing Sheets

(51) Int. Cl.
*B65B 61/18* (2006.01)
*B65B 61/20* (2006.01)

(58) Field of Classification Search
USPC ..... 383/37, 207–209, 906
See application file for complete search history.

(56) References Cited

U.S. PATENT DOCUMENTS 4,506,494 A 3/1985 Shimoyama et al.
4,589,247 A 5/1986 Tsuruta et al.
4,656,818 A 4/1987 Shimoyama et al.
4,768,411 A 9/1988 Su
4,808,010 A 2/1989 Vogan
5,061,534 A 10/1991 Blemberg et al.
5,228,782 A * 7/1993 Imer ..... B65D 75/5822 383/200
5,241,804 A 9/1993 Tsuruta et al.
5,467,581 A 11/1995 Everette
5,558,438 A * 9/1996 Warr ..... B65D 33/08 383/10
5,591,520 A 1/1997 Migliorini et al.
6,221,470 B1 4/2001 Ciocca et al.
6,222,261 B1 4/2001 Horn et al.
6,244,747 B1 6/2001 Caudle
6,472,081 B1 10/2002 Tsai et al.
6,769,227 B2 8/2004 Mumpower et al.
7,160,378 B2 1/2007 Eadie et al.
7,160,604 B2 1/2007 Ginossatis
7,205,040 B2 4/2007 Peiffer et al.
2001/0015054 A1* 8/2001 Caudle ..... B65B 9/20 53/459
2007/0041669 A1* 2/2007 Rosen ..... B65D 75/5816 383/104

FOREIGN PATENT DOCUMENTS

FR 1340983 A * 10/1963
FR 2934576 A1 * 2/2010
JP 2000168804 A * 6/2000
JP 2008074464 A * 4/2008
WO 2004092022 A2 10/2004

OTHER PUBLICATIONS

Machine translation of JP-2000168804-A.*
Machine translation of JP-2008074464-A.*
Machine translation of DE-2624680-A1.*
Written Opinion of the International searching authority in PCT/US2018/046415 dated Feb. 21, 2019.

* cited by examiner

POUCH WITH INTEGRATED SPOUT AND RECLOSABLE FEATURE FOR DISPENSING AND ASSOCIATED METHODS

FIELD OF THE INVENTION

The presently disclosed subject matter relates generally to packages and associated methods of forming packages filled with a product and comprising a reclosable spout. More specifically, embodiments herein describe a pouch with an integrated spout and a spout closure formed exterior to the pouch.

BACKGROUND

Vertical form/fill/seal (VFFS) packaging systems have proven to be very useful in packaging a wide variety of food and non-food pumpable and/or flowable products. Many vertical form/fill/seal systems are commercially available from manufacturers or suppliers such as Hayssen, Illipak, Kartridge Pak, DuPont and Fresco.

One example of such systems is the ONPACK™ family of flowable food packaging systems marketed by Cryovac/Sealed Air Corporation. The VFFS process is known to those of skill in the art, and described for example in U.S. Pat. No. 4,506,494 (Shimoyama et al.), U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), wand U.S. Pat. No. 5,467,581 (Everette). Typically, in such a process, lay-flat thermoplastic film is advanced over a forming device to form a tube, a longitudinal (vertical) fin or lap seal is made, and a bottom end seal is made by transversely sealing across the tube with heated seal bars. A liquid, flowable, and/or pumpable product, such as a liquid, semiliquid, or paste, with or without particulates therein, is introduced through a central, vertical fill tube to the formed tubular film. Squeeze rollers spaced apart and above the bottom end seal squeeze the filled tube and pinch the walls of the flattened tube together. When a length of tubing of the desired height of the bag has been fed through the squeeze rollers a heat seal is made transversely across the flattened tubing by heat seal bars which clamp and seal the film of the tube therebetween. After the seal bars have been withdrawn the film moves downwardly to be contacted by cooled clamping and severing bars which clamp the film therebetween and are provided with a cutting knife to sever the sealed film at about the midpoint of the seal so that approximately half of the seal will be on the upper part of a tube and the other half on the lower. When the sealing and severing operation is complete, the squeeze rollers are separated to allow a new charge of product to enter the flattened tube after which the aforementioned described process is repeated thus continuously producing vertical form/fill/seal pouches which have a bottom end and top end heat seal closure.

The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches cut and thereby separated between two portions of the transverse seals, without the need for a separate step to clamp, cool, and cut the seals. A commercial example of an apparatus embodying this more simplified process is the ONPACK™ 3002 VFFS packaging machine marketed by Cryovac/Sealed Air Corporation.

In some applications, e.g. in a food outlet such as a restaurant, squeeze bottles are filled with a food product from packages made on a VFFS system. Typically, a worker will cut off a corner of the package at a transverse seal, and attempt to pour some or all of the contents of the package into the bottle through the bottle opening. Often the opening is missed, and some product is spilled onto the upper surface of the bottle, the surrounding table, or counter top.

Another problem is that if the package is not completely emptied, and it is desired to retain the remainder of the product for later use, preventing leakage is often an issue. A clip or closure of some sort is required to close the package. These temporary closures can include clips, ties, or bands, but packages so wrapped frequently leak as they are stored on the cooler or ambient storage shelf. Thus, an improved solution that is easier to dispense product and reclosable for later use is desirable.

SUMMARY

Embodiments of the presently disclosed subject matter are directed towards a pouch and methods of forming a pouch for dispensing a flowable product. The pouch may comprise a first end seal at a first end of the pouch, a second end seal at a second end of the pouch, a longitudinal seal extending between the first and second end seals, and an elongated spout formed at least partly by a contour of the first end seal. The pouch may further comprise a spout retainer disposed on an exterior surface of the pouch adjacent to the spout, the spout retainer comprising two layers of material with opposite ends of the spout retainer attached to the exterior surface of the pouch to form two bridges, each of the bridges having a bridge width that is wider than a spout width to allow the spout to pass underneath each of the two bridges. The second end seal may define a recess in the pouch, the recess having a shape corresponding to a shape of the spout. In one embodiment, the spout may extend in a longitudinal direction beyond other portions of the pouch, the spout being flexible and of sufficient length to reach the spout retainer so that it is foldable under each of the two bridges. In one embodiment, a distal end of the spout may be secured to the pouch by a separable perforation. In such an embodiment, the distal end of the spout may be separable from the pouch, the distal end of the spout being flexible and of sufficient length to reach the spout retainer so that it is foldable under each of the two bridges. The spout may be disposed at a lateral end of the first end seal so that the spout is disposed at a corner of the pouch. The spout retainer may be disposed at an angle relative to the longitudinal seal, and in one embodiment, the angle may be 90 degrees or some other non-perpendicular angle. The spout retainer may be secured to the exterior surface of the pouch by a thermal seal or an adhesive. In one embodiment, the spout and the pouch may be formed from the same film material. The spout retainer may be formed from a different film material than the spout and pouch. Furthermore, the spout retainer may be formed from a film having a different color than the spout and the pouch. In one embodiment, the spout retainer may be formed from a different material than the spout and the pouch. In one embodiment, the spout may be tapered so that it has a largest cross section at a proximal end of the spout nearest the pouch and a smallest cross section at a distal end of the spout. The spout may further comprise a plurality of perforations encircling the spout at different positions along the length of the spout.

Other embodiments of the presently disclosed subject matter are directed towards a package for dispensing a product comprising a flexible pouch comprising an elongated spout, a flowable product disposed within the pouch, and a spout retainer disposed on an exterior surface of the pouch adjacent to the spout. Opposite ends of the spout retainer may be attached to the exterior surface of the pouch to form two bridges, each of the bridges having a bridge width that is wider than a spout width to allow the spout to pass underneath each of the two bridges. The spout may extend in a longitudinal direction beyond other portions of the pouch and may be flexible and of sufficient length to reach the spout retainer so that it is foldable under each of the two bridges. In one embodiment, a distal end of the spout is secured to the pouch by a separable perforation so that the distal end of the spout is separable from the pouch and the distal end of the spout being flexible and of sufficient length to reach the spout retainer so that it is foldable under each of the two bridges. The spout may be disposed at a corner of the pouch. The spout retainer may be disposed at an angle relative to the longitudinal seal, said angle being substantially 90 degrees or some other non-perpendicular angle. The spout retainer may be secured to the exterior surface of the pouch by a thermal seal or an adhesive. The spout retainer and the pouch may be formed from different film materials. The spout retainer may comprise two layers of film material.

Other embodiments of the presently disclosed subject matter are directed towards a method of forming a package for dispensing a flowable product from a flexible pouch. The method may comprise the steps of providing a lay-flat web on a first roll, providing a film strip on a second roll; advancing the lay-flat web over a forming device to convert the lay-flat web to a folded web having an interior surface and an exterior surface, advancing the film strip to the lay flat web, cutting the film strip into a strap, positioning the strap at the exterior surface and sealing the strap to the exterior surface at opposite first and second ends of the strap thus forming a strap bridge between the first and second ends of the strap, forming a longitudinal seal in the folded web, transversely sealing the folded web to produce a first transverse seal to define a first pouch, wherein the first transverse seal is a bottom transverse seal of the first pouch, putting a product in the first pouch, advancing by a predetermined distance the folded web and the first pouch, transversely sealing the folded web to produce a second transverse seal forming a top transverse seal in the first pouch, and a third transverse seal forming a bottom transverse seal in a second pouch, the second pouch disposed above the first pouch, the first or the second transverse seal forming a spout with a spout width that is narrower than a width of the strap bridge, and transversely cutting the folded web to separate the first pouch from the second pouch to make a package, the package comprising the pouch with the spout and the strap and the product inside the pouch. The step of sealing the strap to the exterior surface may occur after advancing the lay-flat web over the forming device to convert the lay-flat web to the folded web. Further, the step of sealing the strap to the exterior surface may occurs at any time before or during the step of putting the product in the first pouch.

In the pouch formed according to this method, the first or the second transverse seal opposite the transverse seal in which the spout is formed defines a recess in the pouch, the recess having a shape corresponding to a shape of the spout. In one embodiment, the steps of transversely sealing the folded web comprise forming a spout that extends in a longitudinal direction beyond other portions of the pouch, the spout being flexible and of sufficient length to reach the spout retainer so that it is foldable under the strap bridge. In one embodiment, the method further comprises sealing a portion of the lay flat web between a distal end of the spout and a body of the pouch to form a spout retainer seal and perforating the spout retainer seal. In this embodiment, the distal end of the spout is separable from the pouch, the distal end of the spout being flexible and of sufficient length to reach the spout retainer so that it is foldable under the strap bridge.

The steps of transversely sealing the folded web may comprise forming a spout that is disposed at a lateral end of the first or second transverse seals so that the spout is disposed at a corner of the pouch. The step of sealing the strap to the exterior surface may comprise disposing the strap at an angle relative to the longitudinal seal, said angle being 90 degrees or some other non-perpendicular angle. The step of sealing the strap to the exterior surface may comprise thermally sealing the films or applying an adhesive between the films. The step of advancing the film strip to the lay flat web may comprise advancing two layers of the film strip to the lay flat web.

DETAILED DESCRIPTION

Figure 1:
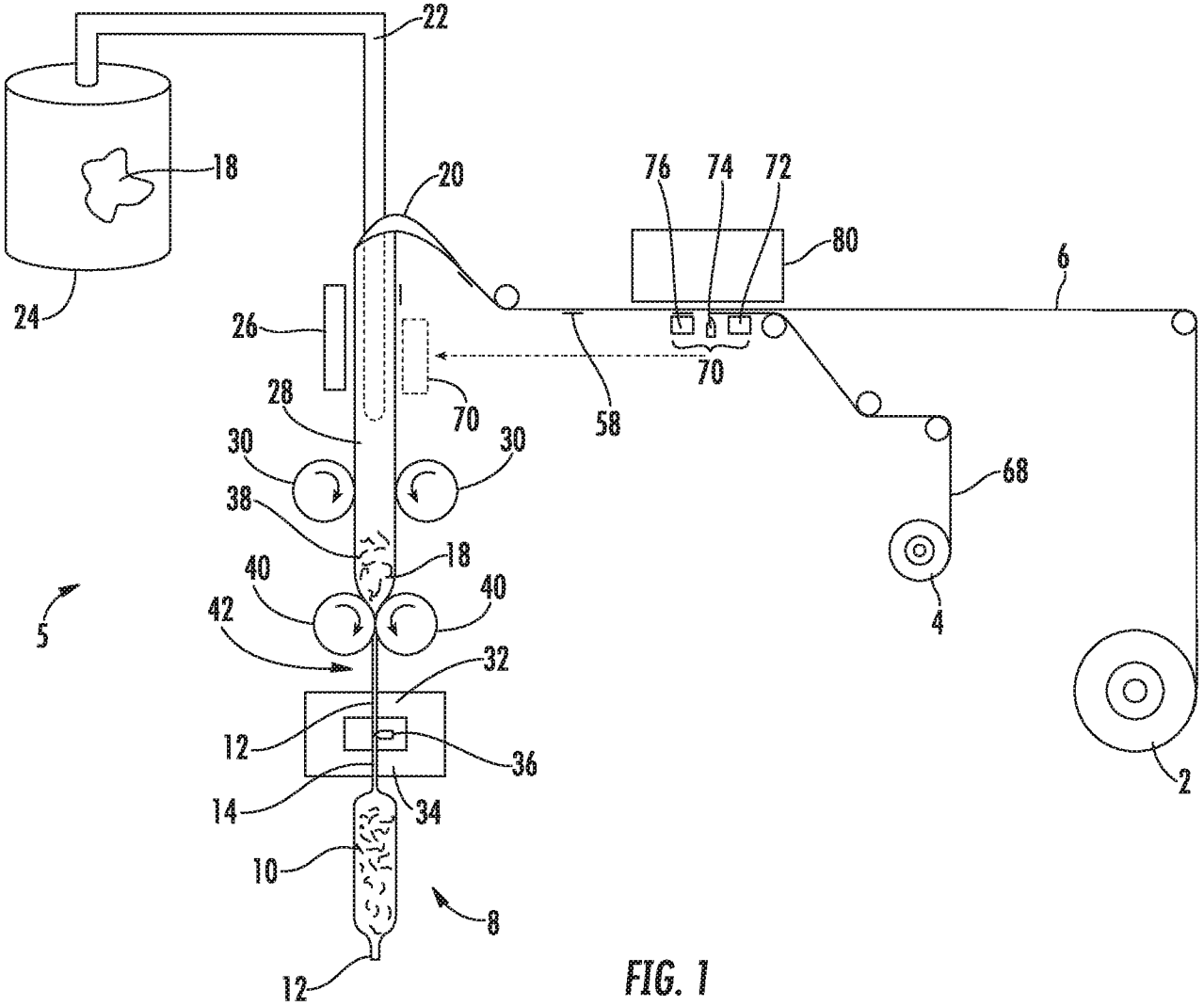
FIG. 1 is a diagrammatic representation of a VFFS process and apparatus for making a package, including a spout closure, in accordance with some embodiments of the presently disclosed subject matter.

The presently disclosed subject matter provides a system and associated methods for packaging flowable products, including for example edible condiments, into a pouch that is reclosable for dispensing at various times. A package for dispensing a product may comprise a flexible pouch with an elongated spout and a flowable product disposed within the pouch. A spout retainer is disposed on an exterior surface of the pouch adjacent to the spout with opposite ends of the spout retainer attached to the exterior surface of the pouch to form two bridges, each of the bridges having a bridge width that is wider than a spout width to allow the spout to pass underneath each of the two bridges. The spout retainer may comprise two layers of material. The package may be manufactured on a vertical form-fill-seal machine where the pouch and spout retainer are formed from different supplies of film material Following long standing patent law convention, the terms "a", "an", and "the" refer to "one or more" when used in the subject application, including the claims. Thus, for example, reference to "a film" includes a plurality of such films, and so forth.

As used herein, the term "film" can be used in a generic sense to include a thermoplastic film, laminate, sheet, or web, either multilayer or monolayer, and of any suitable thickness that may be used in connection with the present invention.

The term "filled" as used herein refers to an item (such as a pouch) that has been occupied with a product in a manner consistent with a commercial filling operation. Thus, a pouch may or may not be 100% filled.

The term "flexible" is used herein to refer to materials that are pliable and easily deform in the presence of external forces. In some embodiments, suitable flexible materials can be characterized by a modulus of less than about 50,000 PSI and in some embodiments less than 40,000 PSI (ASTM D-872-81).

As used herein, the term "pouch" refers to any of the wide variety of containers known in the art, including (but not limited to) bags, packets, packages, and the like.

As used herein, the term "seal" refers to any seal of a first region of a film surface to a second region of a film surface, including heat or any type of adhesive material, thermal or otherwise. In some embodiments, the seal can be formed by heating the regions to at least their respective seal initiation temperatures. The sealing can be performed by any one or more of a wide variety of methods, including (but not limited to) using a heat seal technique (e.g., melt-bead sealing, thermal sealing, impulse sealing, dielectric sealing, radio frequency sealing, ultrasonic sealing, hot air, hot wire, infrared radiation).

Any direction referred to herein, such as "top," "bottom," "left," "right," "upper," "lower," and other directions and orientations are described for clarity in reference to the figures and are not to be limiting. It is to be understood that the films or systems described herein can be used in a wide variety of directions and orientations.

All compositional percentages used herein are presented on a "by weight" basis, unless designated otherwise.

Although the majority of the above definitions are substantially as understood by those of skill in the art, one or more of the above definitions can be defined hereinabove in a manner differing from the meaning as ordinarily understood by those of skill in the art, due to the particular description herein of the presently disclosed subject matter.

FIG. 1 schematically illustrates a VFFS apparatus 5 that can be used in the process of making a product filled package 8 in accordance with the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), U.S. Pat. No. 5,467,581 (Everette), and U.S. Pat. No. 6,244,747 (Caudle).

Apparatus 5 utilizes a lay-flat film 6 to create a flexible container for the product 18. Product 18 is manually or mechanically supplied to the upper end portion of forming device 20 via any conventional means, such as a funnel or dispensing line 22. In the embodiment shown, product 18 is supplied to the VFFS apparatus 5 from a product container 24. The product 18 can be any food or non-food product, liquid, semi-liquid, or paste, e.g, flowable or pumpable high acid or low acid foods, such as tomato products, milk or dairy products, condiments, medical products, or the like.

Packages are formed in a lower portion of apparatus 5. Film 6 from which the packages are formed is advanced from a feed roller 2, over forming device 20 (sometimes known as a "sailor's collar" or "forming collar"). As the film 6 passes over the forming device 20, opposite sides of the film 6 are brought together and subsequently joined with a longitudinal seal 16 formed by longitudinal heat sealing device 26. As used herein, the term "longitudinal" shall be interpreted to mean in a direction of the longitudinal seal 16 and corresponds to the direction of travel of the film 6 within the VFFS apparatus 5 as the pouches 10 are being formed and filled. Once the longitudinal seal 16 is formed, the film 6 takes the shape of a vertically-oriented film tube 28. In general, the film 6 will travel vertically downward from the forming device 20 towards the lower portion of apparatus 5, where transverse heat seal bars 32, 34 operate to close and seal horizontally across the lower end of film tube 28, to form a pouch 10 having a first transverse seal 12. Pouch 10 is thereafter filled with product 18.

Film feed mechanism 30, powered and directed by rollers and/or a belt, as illustrated, or by a suitable alternative motive device, advances the film tube 28 and pouch 10 downward a predetermined distance to create a pouch 10 having a desired length. Squeeze rollers 40 may be incorporated to close on the moving film in order to meter the amount of product in the pouch and to void/clean the area 42 where a transverse seal is to be applied. Seal bars 32, 34 close and seal horizontally across the lower end of film tube 28 to form a first transverse seal 12 at the bottom of the film tube 28, while simultaneously sealing horizontally across upper end of sealed pouch 10 to form a second transverse seal 14. The next pouch 38 above, is then filled with a metered quantity of product 18, then advanced downwardly, and the packaging cycle is repeated. A cut-off knife 36 may be situated between upper 32 and lower 34 seal bars to sever a lower sealed pouch 10 from the bottom of upstream pouch 38.

Figure 2:
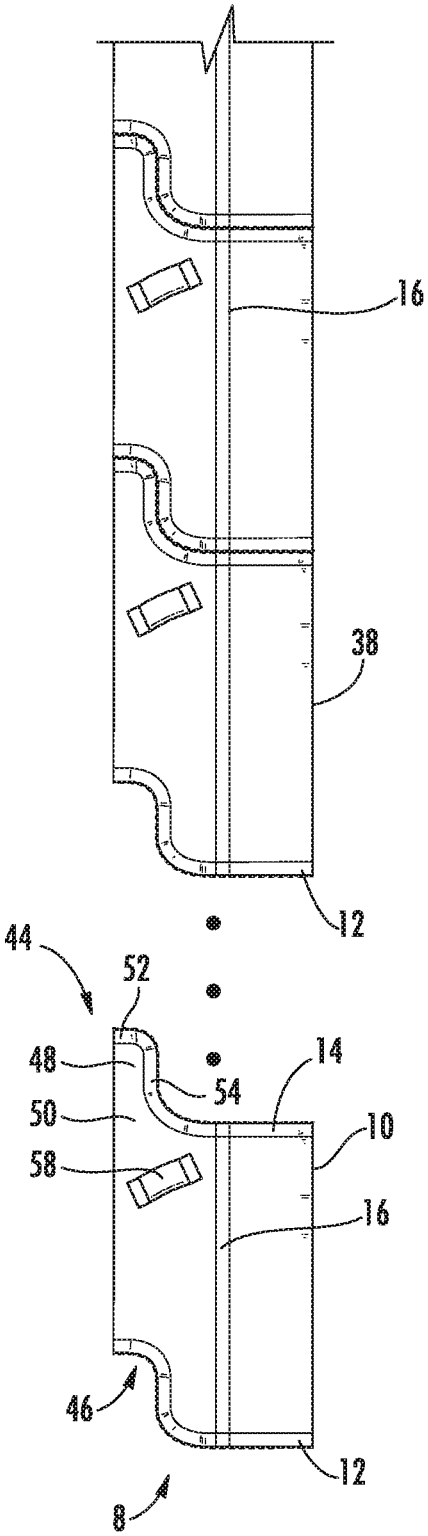
FIG. 2 is a schematic representation of a sequence of packages formed in accordance with some embodiments of the presently disclosed subject matter.
Figure 3:
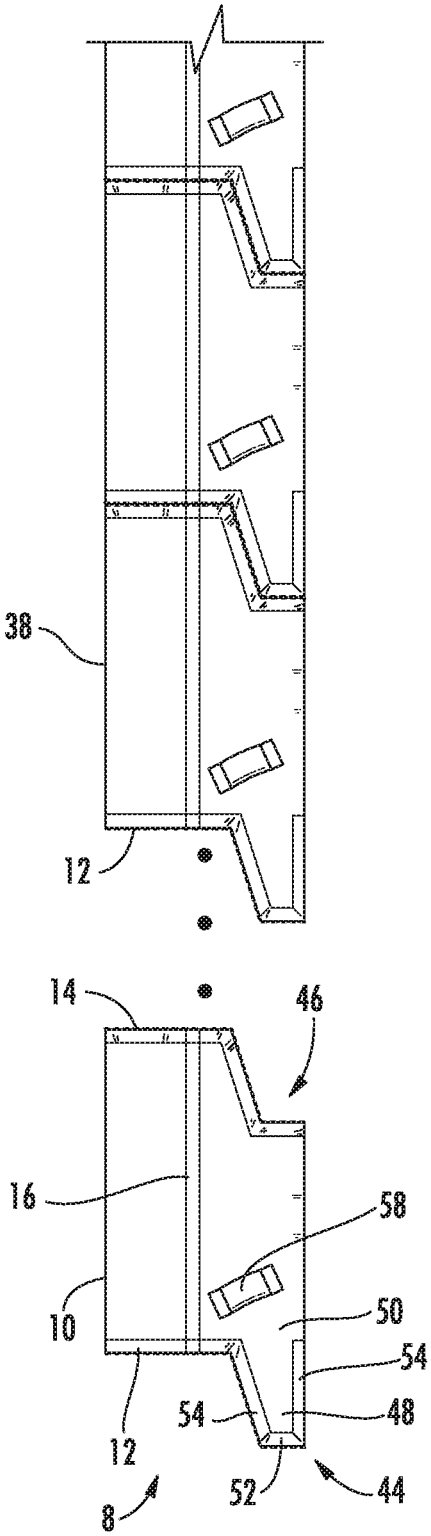
FIG. 3 is a schematic representation of a sequence of packages formed in accordance with some embodiments of the presently disclosed subject matter.

The VFFS apparatus 5 configured in this manner can produce a package 8 or a sequence of packages 8 as shown schematically in FIGS. 2 and 3. Although the overall shape of the packages 8 shown FIGS. 2 and 3 differs, each includes similar features described above and elsewhere herein. For instance, each package 8 includes a pouch 10 with first 12 and second 14 transverse seals and a longitudinal seal 16 extending between the first and second transverse seals. These exemplary pouches 10 include a spout 44 that is formed by a contour of either the first transverse seal 12 or the second transverse seal 14. In these illustrated embodiments, the spout 44 extends in a longitudinal direction beyond other portions of the pouch 10. Also, where a VFFS apparatus 5 may form a second transverse seal 14 of a first pouch 10 at the same time as a first transverse seal 12 of a subsequent pouch 38, those first and second transverse seals may have corresponding contours. Consequently, in some embodiments, a pouch recess 46 may be formed by a contour of a transverse seal 12, 14 opposite spout 44. In FIG. 2, the pouch 10 includes first 12 and second 14 transverse seals following a curved contour. In FIG. 3, the pouch 10 includes first 12 and second 14 transverse seals with linear, angled contours.

Figure 15:
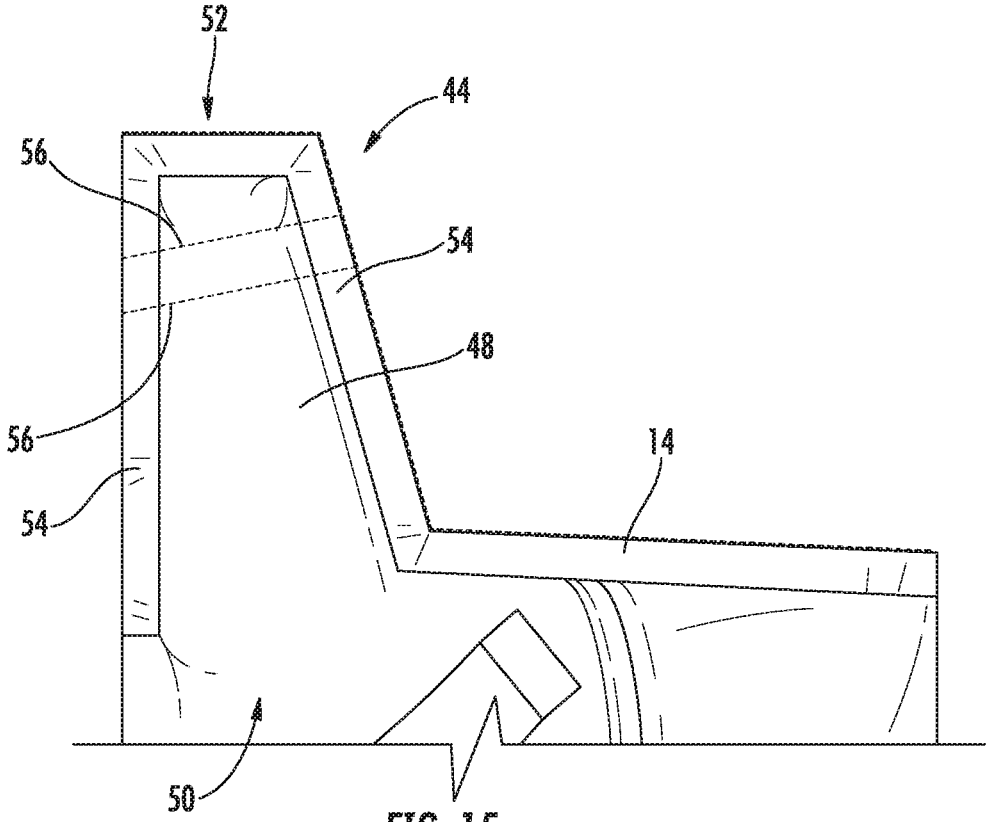
FIG. 15 is a detail view of a package spout in accordance with some embodiments of the presently disclosed subject matter.

As shown more clearly in FIG. 15, spout 44 includes an interior channel 48 in communication with the pouch interior. Channel 48 is defined by an open end 50 facing the interior of pouch 10, spout end 52 that before opening is in a sealed condition, and one or more marginal lateral seals 54. Spout 44 also optionally includes a tear notch 56. In fact, a plurality of tear notches 56 may be incorporated into the spout 44 at different positions along the spout 44, that when opened form a different size spout end 52 to provide users some measure of control over pour rates.

Figure 4A:
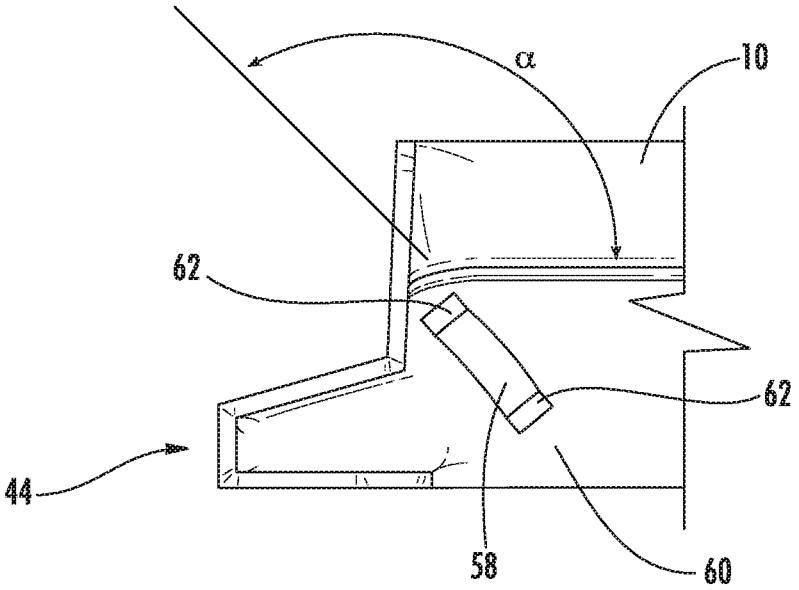
FIGS. 4A-4C illustrate a plan view of an embodiment of a package and a sequence of steps in re-closing a spout in accordance with some embodiments of the presently disclosed subject matter.
Figure 4B:
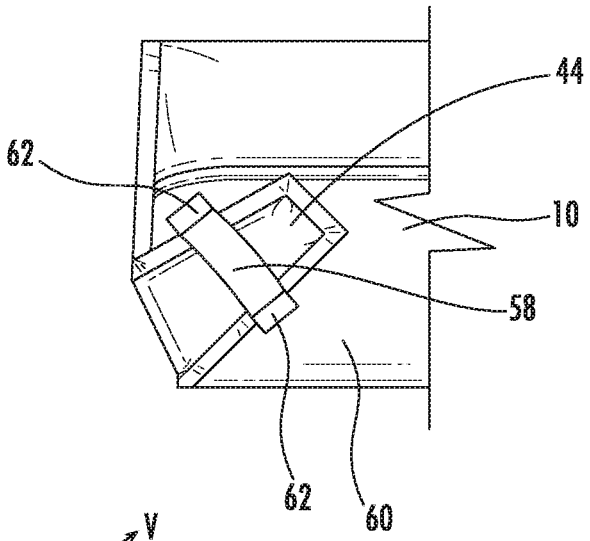
Figure 4C:
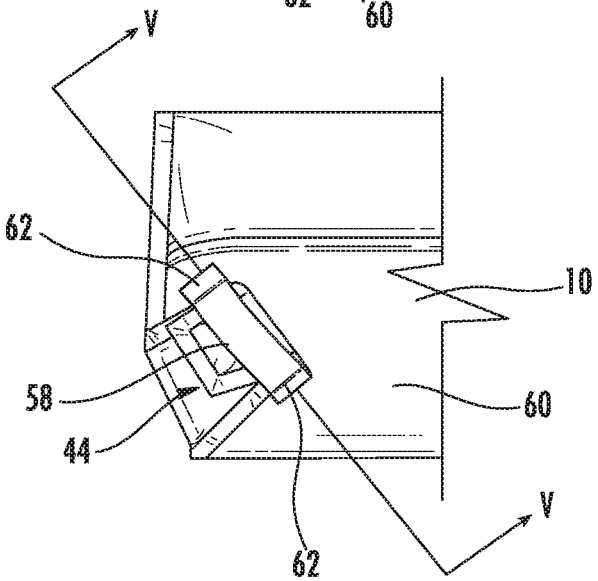
Figure 5:
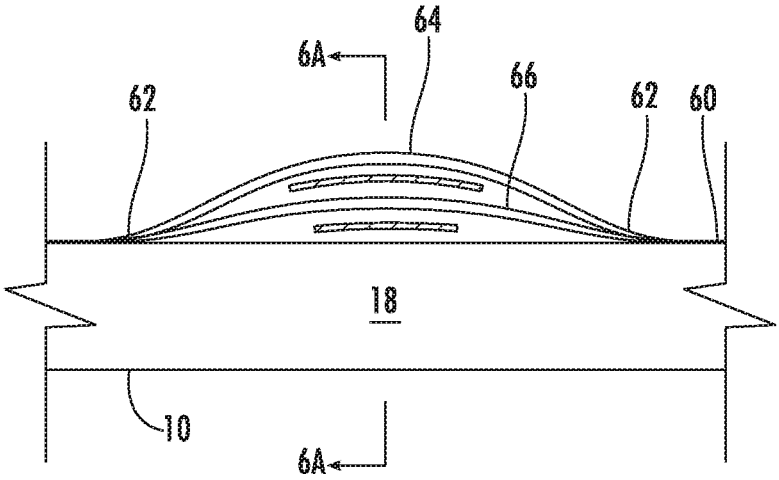
FIG. 5 is a partial section view of a package and spout retainer in accordance with some embodiments of the presently disclosed subject matter.
Figure 6A:
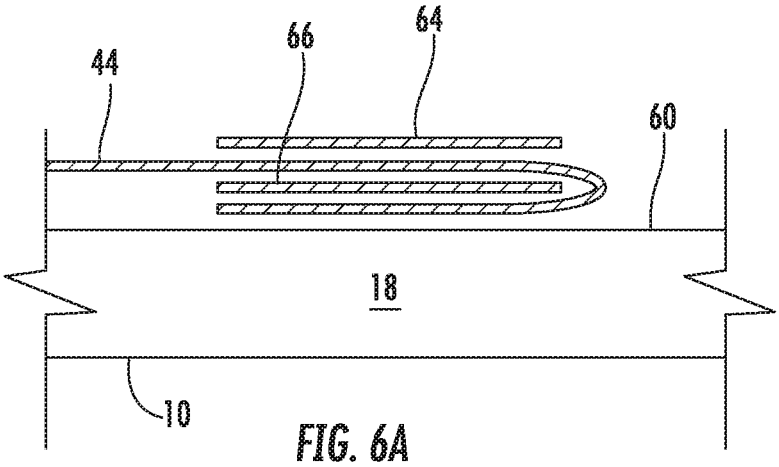
FIGS. 6A and 6B are partial section views of a package and spout retainer in accordance with some embodiments of the presently disclosed subject matter.
Figure 6B:
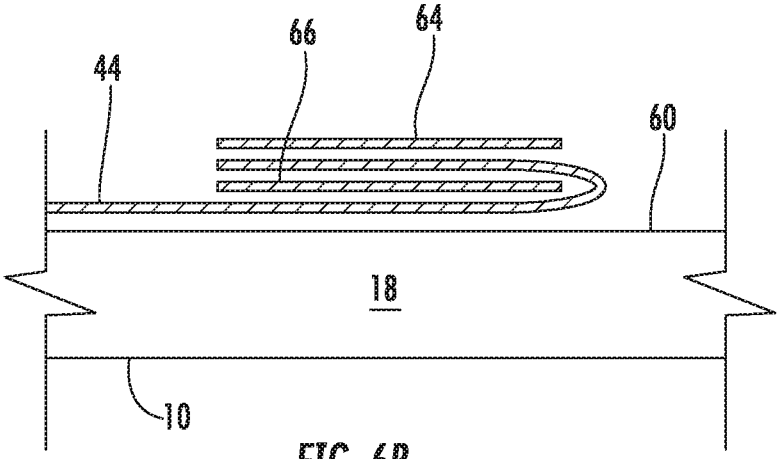

The various embodiments of package 8 include a spout retainer strap 58 that is sized and positioned so that after the spout 44 is opened to dispense the product 18, the spout 44 can be re-closed and tucked away under the strap 58 for later use. In general, the strap 58 is attached at opposite ends 62 of the strap 58 to an outside surface 60 of the pouch 10. In one embodiment, the strap 58 comprises two layers of film that, as shown in FIG. 5, create an outer bridge 64 and an inner bridge 66. In general, each bridge 64, 66 is wide enough (i.e., the distance between the attached opposite ends 62) that the spout 44 may pass underneath. For example, FIGS. 4A-40 illustrate a sequence of steps in which the spout 44 is tucked under the bridges 64, 66 to re-close the package 8. In FIG. 4A, the spout 44 is in its normal, open position. In FIG. 48, the spout 44 is then tucked a first time under a first bridge 64 or 66 of the strap 58. Finally, in FIG. 4C, the spout 44 is tucked a second time under a second bridge 66 or 64 of the strap 58. FIGS. 6A and 6B illustrate different techniques for tucking the spout 44 under the different bridges 64, 66 of the strap 58. In a first technique shown in FIG. 6A, the spout 44 can be tucked initially under the outer bridge 64, then folded back in the reverse direction under the inner bridge 66. In a second technique shown in FIG. 6B, the spout 44 can be tucked initially under the inner bridge 66, then folded back in the reverse direction under the outer bridge 64.

In this particular embodiment, the strap 58 includes a two layer, stacked bridge configuration. In one embodiment, the strap 58 may be applied to the pouches 10 after they are produced by the VFFS apparatus 5. That is, the strap 58 may be applied in a separate process step following the formation of the pouches 10 and packages 8 on the VFFS apparatus 5. However, in a preferred embodiment, the strap 58 may be applied to the pouches 10, or to the film tube 28, or to the lay-flat film 6 on the VFFS apparatus 5 as shown in FIG. 1. For instance, the strap 58 may be formed from a strap film 68 that is advanced from a feed roller 4 towards an application station 70 where the strap is advanced, cut, and attached to the lay-flat film 6 upstream of the forming device 20. Alternatively, the strap 58 may be formed from a strap film 68 that is advanced, cut, and attached to the film tube 28 downstream of the forming device 20, preferably at a location before product 18 begins to fill the film tube 28.

The application station 70 includes an indexer 72 that advances the strap film 68 a desired amount to establish a desired width or length of the strap 58. The application station 70 also includes a cut-off knife 74 that cuts the strap film 68 to the desired width or length of the strap 58 and a sealer 76 that attaches the strap 58 to the lay-flat film 6 or to the film tube 28. Notably, in the illustrated example, the strap 58 is attached to the underside of the lay-flat film 6 or to the outside of the film tube 28 so that the strap will appear on an outside surface 60 of the pouch 10. The opposite ends 62 of the strap 58 may be attached to the outside surface of the pouch 10 by an adhesive material, a thermal seal or otherwise. In some embodiments, the seal can be formed by heating the regions to at least their respective seal initiation temperatures. The sealing can be performed by any one or more of a wide variety of methods, including (but not limited to) using a heat seal technique (e.g., melt-bead sealing, thermal sealing, impulse sealing, dielectric sealing, radio frequency sealing, ultrasonic sealing, hot air, hot wire, infrared radiation). In some instances, a backing surface 80 may be provided on an opposite side of the lay-flat film 6 to provide support for the application station 70 and facilitate application of the strap 58 to the film 6.

Figure 7:
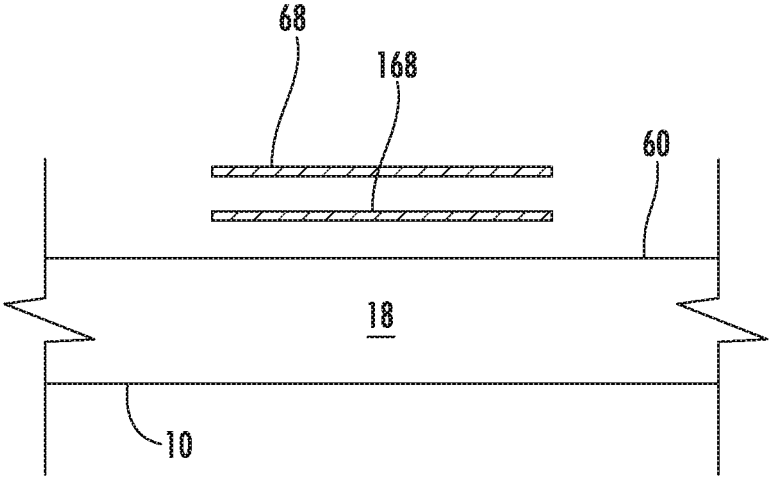
FIG. 7 is a partial section view of a package and film for forming a spout retainer in accordance with some embodiments of the presently disclosed subject matter.
Figure 8:
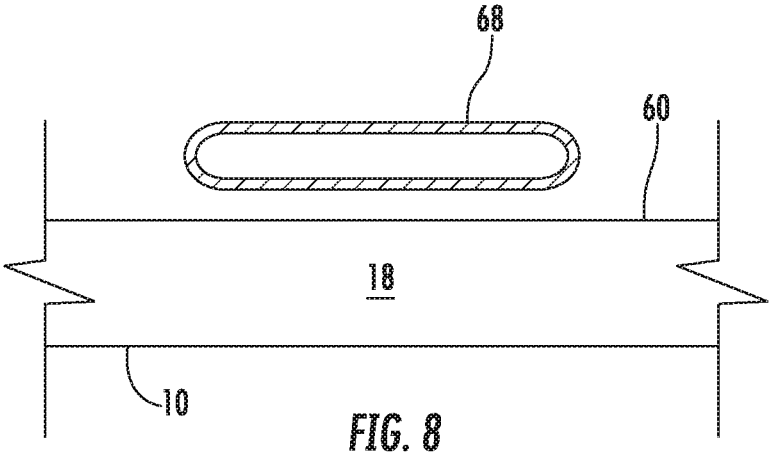
FIG. 8 is a partial section view of a package and film for forming a spout retainer in accordance with some embodiments of the presently disclosed subject matter.
Figure 9:
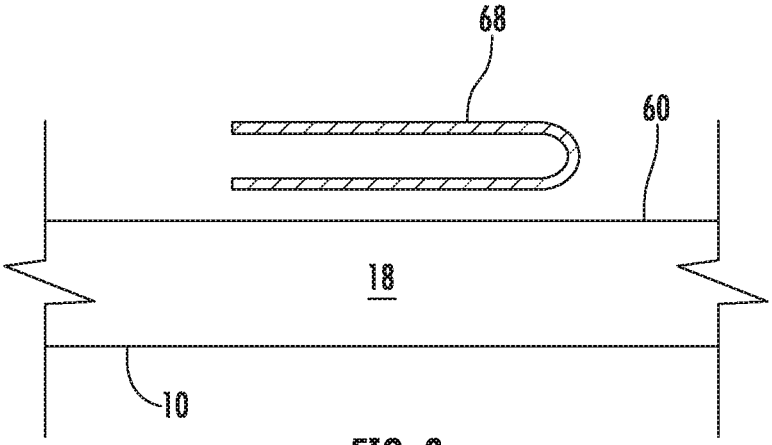
FIG. 9 is a partial section view of a package and film for forming a spout retainer in accordance with some embodiments of the presently disclosed subject matter.

For the two layer, stacked bridge configuration shown in FIG. 5, the strap film 68 that is advanced from a feed roller 4 can have different shapes or configurations. For example, FIGS. 7, 8, and 9 show different examples of the strap film 68, 168 that can be attached to the lay-flat film 6 at the application station 70 to create the configuration shown in FIG. 5. In one embodiment, shown in FIG. 7, two separate films 68, and 168 may be advanced from a single feed roller 4. Alternatively, film 68 may be advanced from feed roller 4 and film 168 may be fed from a separate feed roller (not shown). Alternatively, both layers of film may be formed form a single film 68 and cut into the two separate layers at the application station. In an alternative embodiment shown in FIG. 8, the film 68 advanced from feed roller 4 may take the form of a tube of film that is cut and attached to the lay-flat film 6 at the application station 70. In yet another alternative embodiment shown in FIG. 9, both layers of the two-layer stacked bridge may be formed form a single film 68 that is cut and folded into the two separate layers at the application station 70.

Figure 10:
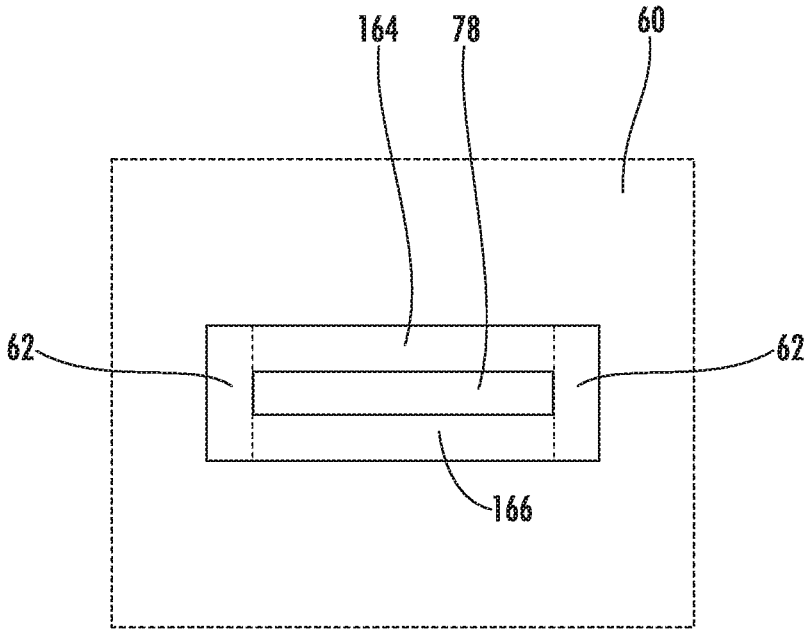
FIG. 10 is a partial plan view of a package and spout retainer in accordance with some embodiments of the presently disclosed subject matter.
Figure 11:
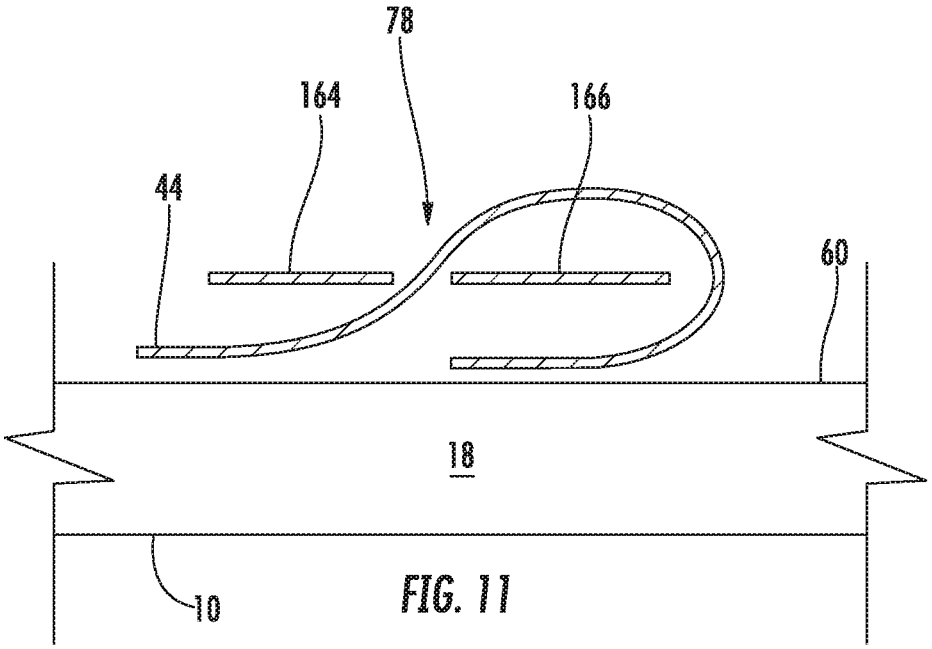
FIG. 11 is a partial section view of a package and spout retainer in accordance with some embodiments of the presently disclosed subject matter.
Figure 12:
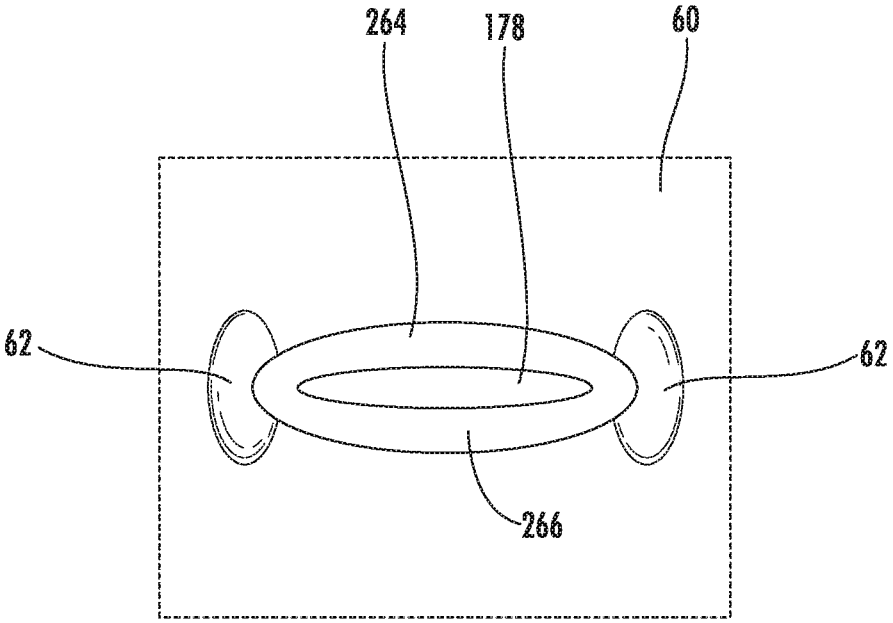
FIG. 12 is a partial plan view of a package and spout retainer in accordance with some embodiments of the presently disclosed subject matter.
Figure 13:
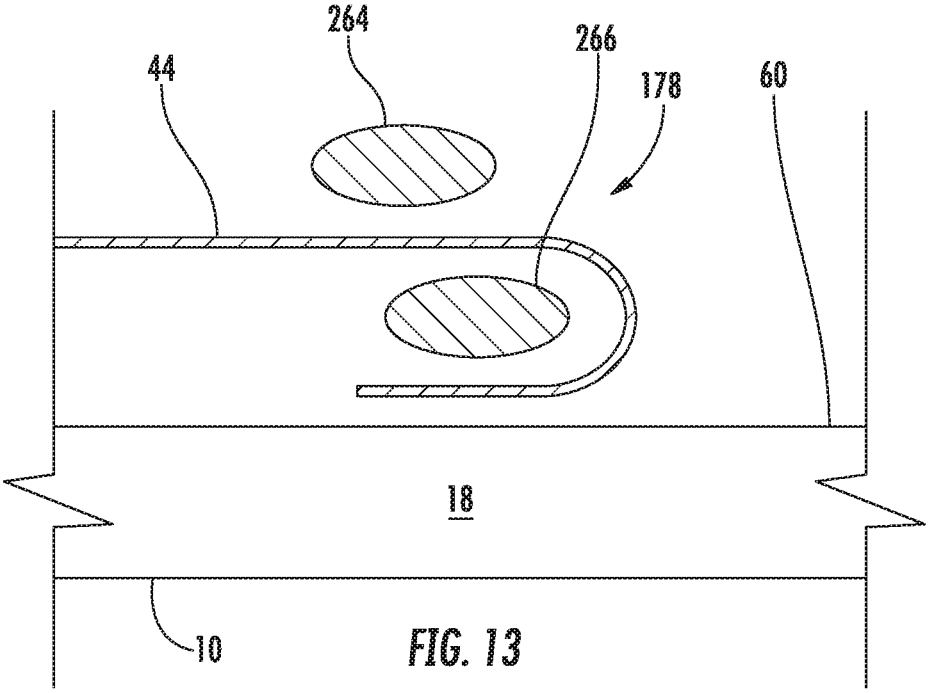
FIG. 13 is a partial section view of a package and spout retainer in accordance with some embodiments of the presently disclosed subject matter.

FIGS. 10 and 11 illustrate an alternative embodiment of a spout strap 58 that is formed from a single film layer and the individual bridges 164, 166 are disposed side by side and separated by a central slit 78. In this embodiment, the individual bridges 164, 166 are not stacked. With this configuration, the spout 44 can be tucked initially under the first bridge 164, then passed upward through the slit 78, and folded back in the reverse direction under the second bridge 166. In this embodiment, the strap 58 may be formed by a single piece of material and not with multiple layers or folded layers of film material as in embodiments described above. FIGS. 12 and 13 illustrate an alternative embodiment of a spout strap 58 that is formed by non-flat bridges 264, 266 that can be attached to the pouch 10 in either a stacked or a side by side configuration. The non-flat bridges might be formed by rope, cord, extruded plastic, filament, or a variety of different materials. The non-flat bridges 264, 266 are separated by a central slit 178. With this configuration, the spout 44 can be tucked initially under the first bridge 264, then passed upward through the slit 178, and folded back in the reverse direction under the second bridge 266.

Figure 14:
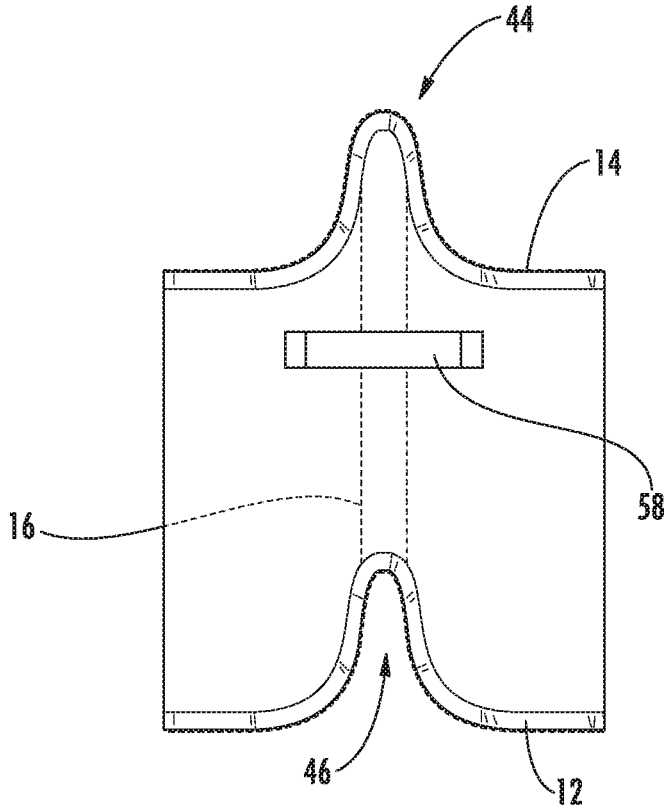
FIG. 14 is a plan view of a package and spout retainer in accordance with some embodiments of the presently disclosed subject matter.

FIG. 14 shows an alternative embodiment of a pouch 10 in which the spout 44 is disposed at or near a centerline of the pouch 10, near the longitudinal seal 16. In this embodiment, the spout 44 and pouch recess 46 are approximately aligned with the longitudinal seal 16. Furthermore, the spout strap 58 is disposed adjacent the spout and oriented so that the strap 58 extends in a direction that is nearly perpendicular to the longitudinal seal 16. This is because the spout 44, when positioned in the center of a transverse seal 12, 14, will generally fold (for re-closure) in a direction parallel to the longitudinal seal 16. Compare for example, the embodiments shown in FIGS. 2, 3, and 4, where the spout is disposed at or near a side of the transverse seals 12, 14 (i.e., at a corner of the pouch 10), and the strap is oriented at an angle $\alpha$ that is not perpendicular to the transverse seal. As depicted in FIG. 4A, this angle $\alpha$ is an obtuse angle. This is because the spout 44, when positioned at the side of a transverse seal 12, 14, will naturally fold (for re-closure) at an angle, in a direction that is not parallel to the longitudinal seal 16. For either instance, the orientation of the strap 58 should be optimized to allow the spout 44 to be tucked into the strap 58 with ease.

Figure 16A:
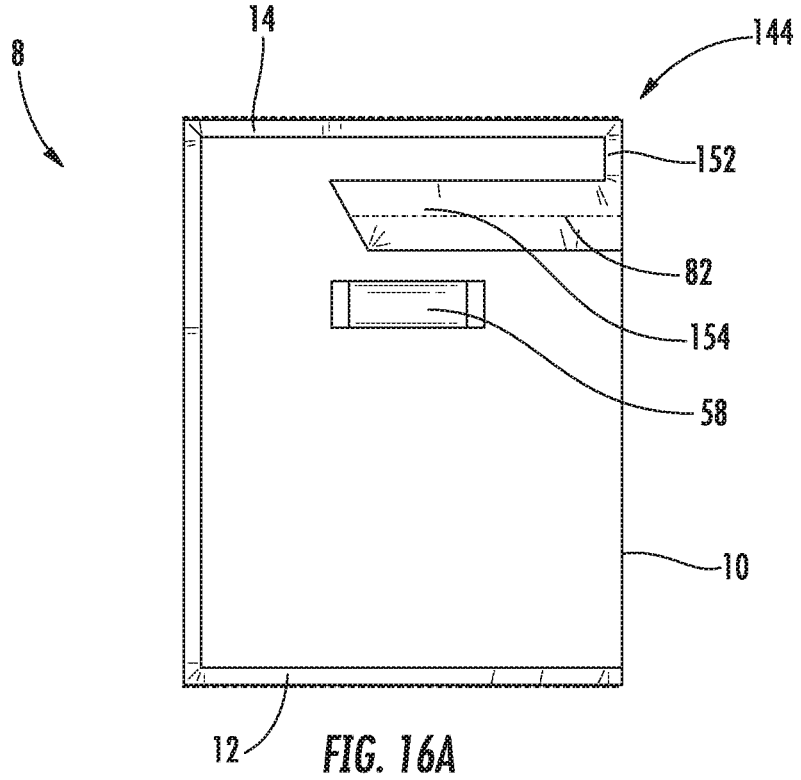
FIGS. 16A and 16B illustrate a plan view of a package and spout retainer, with a spout in different positions in accordance with some embodiments of the presently disclosed subject matter.
Figure 16B:
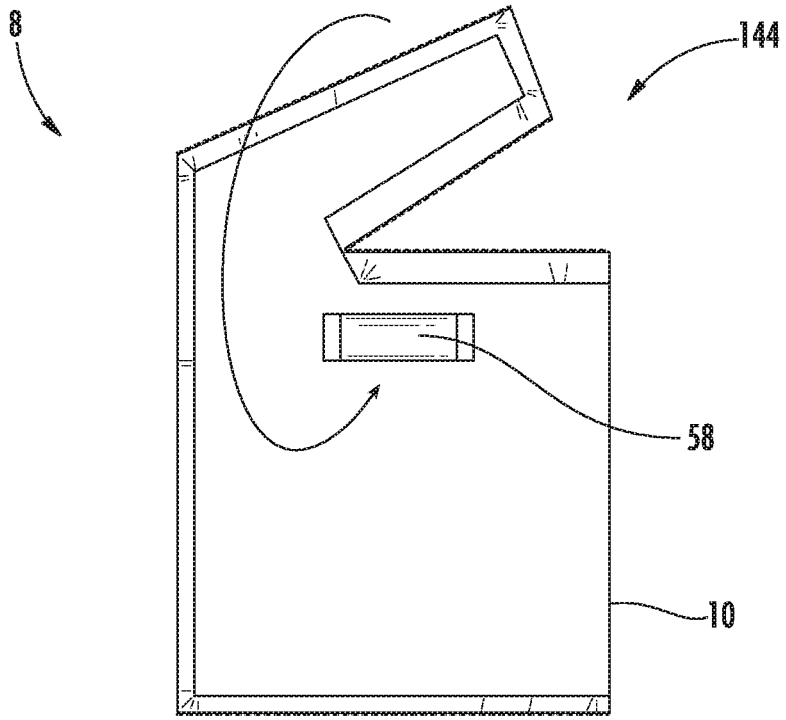

FIGS. 16A and 16B show an alternative embodiment, where spout 144, at least initially, does not extend longitudinally beyond other regions of the pouch 10. In this instance, a distal end 152 of the spout 144 is secured to the pouch 10 by a separable perforation 82. Here, a portion of the lay flat web 6 between the distal end 152 of the spout 144 and a body of the pouch forms a spout retainer seal 154. The perforation 82 is formed in the spout retainer seal 154. When an operator wishes to dispense product 18 from the package 8, the distal end 152 of the spout 144 is separated from the main pouch body by opening the perforation 80, the distal end 152 of the spout 144 is opened and the product is dispensed therefrom. Once a desired amount of product is dispensed from the pouch 10, the spout 144 can be re-closed for further use by tucking the spout 144 into the strap 58 as disclosed above. To that end, the distal end 152 of the spout 144 should be flexible and of sufficient length to reach the spout strap 58 so that it is foldable under each of the two bridges as discussed.

Embodiments of the disclosed strap 58 and pouch 10 can be constructed from any of a wide variety of polymeric materials known in the art, including in some embodiments food safe materials and/or a base film having a food safe material coated thereon. In some embodiments, the strap can be a continuous strip of material that spans the entire pouch width, transverse to the machine direction, e.g. perpendicular to the pouch longitudinal seal. In these embodiments, the strap can be indexed from a roll and applied (sealed, adhered, or the like) to a pouch. Alternatively, in some embodiments, the strap can be an intermittent strip (registered film) positioned at the exterior of the pouch 60. In these embodiments, the strap can be indexed from a roll and applied at a desired location of the pouch film web. Alternatively, the strap can run continuously in the longitudinal or other suitable direction. In some embodiments, the strap can be constructed from one or more semi-rigid materials (e.g., EVA sealant/semi-rigid layer/lock down sealant) that can be registered and applied on an end of the pouch at an angle to or perpendicular to the pouch longitudinal seal. In an alternative embodiment, a food grade cold seal can be used.

A film used to construct the disclosed pouch and/or strap can be multilayer or monolayer. Typically, the films employed will have two or more layers to incorporate a variety of properties, such as, for example, sealability, gas impermeability, and toughness into a single film. Thus, in some embodiments, the films can comprise a total of from 1 to 20 layers, such as from 4 to 12, or from 5 to 9 layers. The films can comprise more than 20 layers e.g. in embodiments wherein the films comprise microlayering technology.

The films used to construct pouch 60 and/or the disclosed strap 58 can include one or more barrier layers, bulk layers, tie layers, abuse layers, and/or sealant layers, e.g., at least one barrier layer such that the pouch has an oxygen transmission rate of no more than about 50 cc/m2/24 hr. at 25° C., 0% RH, 1 atm (in accordance with ASTM D 3985).

The polymer components used to fabricate the films can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films. See, for example, U.S. Pat. Nos. 7,205,040; 7,160,378; 7,160,604; 6,472,081; 6,222,261; 6,221,470; 5,591,520; and 5,061,534. In some embodiments, pouch 60 can be constructed from a food grade material, as would be well known to those of ordinary skill in the art.

The films used to construct pouch 60 and the disclosed strap 58 can have any total thickness so long as they provide the desired properties for the particular packaging operation in which they are to be used. Nevertheless, in some embodiments the disclosed films have a total thickness of from 0.1 mils to 20 mils, such as from 0.2 mils to 10 mils; 0.3 mils to about 5.0 mils; and from 1.0 mils to 3.0 mils.

The films can be provided in sheet or film form and can be any of the films commonly used for the disclosed type of packaging, and can be constructed by any suitable process including e.g. coextrusion, lamination, extrusion coating, and combinations thereof. See, for example, U.S. Pat. No. 6,769,227.

In some embodiments, the films can be transparent (at least in any non-printed regions) such that the packaged product is at least partially visible through the films. The transparency of the films can be at least about any of the following values: 20%, 25%, 30%, 40%, 50%, 65%, 70%, 75%, 80%, 85%, and 95%.

In some embodiments the films used to construct pouch 60 or strap 58 can be pigmented, tinted, or printed. Printing can be employed at any time prior to use of the pouch. In some embodiments, pouch 60 can be ink jet or thermal transfer printed using a device mounted on a packaging machine that forms and seals the pouch. In some embodiments, the strap film 68 and subsequently formed strap 58 may have a color or other visual differentiator, whether by pigments, dyes, inks, branding, product information, markings, arrows, written instructions, and the like to provide users a visual cue indicating how and where the spout 44 may be reclosed.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For example, while the use of a VFFS apparatus 5 provides for efficient formation of embodiments of the packages 8 disclosed herein, there is no specific requirement that the pouches be formed on such a machine. The invention should therefore not be limited by the above described embodiment, method, and examples, but by all embodiments and methods within the scope and spirit of the invention as claimed.

What is claimed is:

1. A sequence of packages, wherein each package in the sequence of packages includes a pouch for dispensing a flowable product, the pouch comprising:

a first end seal at a first end of the pouch, a second end seal at a second end of the pouch, a longitudinal seal extending between the first and second end seals, and an elongated spout formed at least partly by a contour of the first end seal, wherein the second end seal defines a pouch recess having a shape corresponding to a shape of the elongated spout, wherein the elongated spout extends into a pouch recess of an adjacent package in the sequence of packages; and a spout retainer disposed on an exterior surface of the pouch adjacent to the spout, the spout retainer comprising two layers of material with opposite ends of the spout retainer attached to the exterior surface of the pouch to form two bridges, each of the bridges having a bridge width that is wider than a spout width to allow the spout to pass underneath each of the two bridges;

wherein the two bridges of the spout retainer include an inner bridge and an outer bridge in a stacked configuration such that portions of the spout can pass between the inner bridge and the pouch and/or between the outer bridge and the inner bridge.

2. The sequence of packages of claim 1 wherein the spout extends in a longitudinal direction beyond other portions of the pouch, the spout being flexible and of sufficient length to reach the spout retainer so that it is foldable under each of the two bridges.

3. The sequence of packages of claim 1 wherein:

a distal end of the spout is secured to the pouch by a separable perforation; and the distal end of the spout is separable from the pouch, the distal end of the spout being flexible and of sufficient length to reach the spout retainer so that it is foldable under each of the two bridges.

4. The sequence of packages of claim 1 wherein the spout is disposed at a lateral end of the first end seal so that the spout is disposed at a corner of the pouch.

5. The sequence of packages of claim 1 wherein the spout retainer is at least one of:

disposed at an angle relative to the longitudinal seal;

disposed at a non-perpendicular angle relative to the longitudinal seal;

secured to the exterior surface of the pouch by a thermal seal or an adhesive;

formed from the same film material as the spout;

formed from a different film material than the spout and pouch;

formed from a film having a different color than the spout and the pouch; or formed from a different material than the spout and the pouch.

6. The sequence of packages of claim 1 wherein the spout is tapered and has a largest cross section at a proximal end of the spout nearest the pouch and a smallest cross section at a distal end of the spout, the spout further comprising a plurality of perforations encircling the spout at different positions along the length of the spout.

* * * * *